US008914168B2

(12) United States Patent
Chundru et al.

(10) Patent No.: US 8,914,168 B2
(45) Date of Patent: Dec. 16, 2014

(54) SYSTEM AND METHOD FOR AUTOMATED LOCOMOTIVE STARTUP AND SHUTDOWN RECOMMENDATIONS

(75) Inventors: Srinivas Chundru, Broomfield, CO (US); Patrick J. Student, Elkhorn, NE (US); Tim L. Prince, Omaha, NE (US); Allen H. Buchheit, Belleville, IL (US)

(73) Assignee: Union Pacific Railroad Company, Omaha, NE (US)

( * ) Notice: Subject to any disclaimer, the term of this patent is extended or adjusted under 35 U.S.C. 154(b) by 0 days.

(21) Appl. No.: 13/585,535

(22) Filed: Aug. 14, 2012

(65) Prior Publication Data

US 2013/0268147 A1 Oct. 10, 2013

Related U.S. Application Data

(60) Provisional application No. 61/620,883, filed on Apr. 5, 2012.

(51) Int. Cl.

| | |
|---|---|
| ***G06F 7/06*** | (2006.01) |
| ***B60L 3/00*** | (2006.01) |
| ***B61C 17/12*** | (2006.01) |
| *B61L 3/12* | (2006.01) |
| *B61L 15/00* | (2006.01) |
| *B61L 3/00* | (2006.01) |
| *B61L 3/14* | (2006.01) |

(52) U.S. Cl.

CPC ..... *B61C 17/12* (2013.01); *B61L 3/127* (2013.01); *B61L 15/0027* (2013.01); *B61L 15/0036* (2013.01); *B61L 3/006* (2013.01); *B61L 3/14* (2013.01)

USPC ..... 701/19; 701/20; 246/186

(58) Field of Classification Search

CPC ..... B61L 3/006; B61L 3/14; B61L 3/127; B61L 15/0027; B61L 15/0036; B61C 17/12

USPC ..... 701/19, 20; 246/186, 187

See application file for complete search history.

(56) References Cited

U.S. PATENT DOCUMENTS

| | | | | |
|---|---|---|---|---|
| 4,041,283 | A * | 8/1977 | Mosier | 701/20 |
| 4,042,810 | A * | 8/1977 | Mosher | 701/19 |
| 4,266,485 | A | 5/1981 | Bruner et al. | |
| 4,793,047 | A * | 12/1988 | Curtis et al. | 29/407.08 |
| 5,530,328 | A | 6/1996 | Fernandez et al. | |
| 5,975,649 | A * | 11/1999 | Maruta et al. | 303/7 |
| 6,311,109 | B1 * | 10/2001 | Hawthorne et al. | 701/19 |
| 7,522,990 | B2 | 4/2009 | Daum et al. | |
| 7,761,198 | B2 * | 7/2010 | Bhardwaj | 701/19 |

(Continued)

*Primary Examiner* — Calvin Cheung
*Assistant Examiner* — Angelina Shudy
(74) *Attorney, Agent, or Firm* — Thompson Coburn LLP

(57) ABSTRACT

Data representative of a train consist (the train consist comprising a plurality of locomotives and a plurality of cars) and data representative of a route for the train consist can be processed by a processor to automatically determine which locomotives in the train consist should be powered on and which locomotives in the train consist should be shut down for each segment of the route. The processor can make these determinations based on an analysis of the train consist data and the route data with respect to a plurality of considerations that affect train efficiency. Recommendations for locomotive startups and shutdowns in accordance with such automated determinations can then be presented to the train crew for the crew to use during train operations. It is believed that when train crews are in compliance with such recommendations, significant improvements in efficiency, particularly with respect to fuel consumption, can be achieved.

53 Claims, 9 Drawing Sheets

(56) References Cited

U.S. PATENT DOCUMENTS

| | | | | |
|---|---|---|---|---|
| 7,778,747 | B2 * | 8/2010 | Hawkins et al. | 701/22 |
| 7,974,774 | B2 | 7/2011 | Kumar | |
| 8,370,006 | B2 * | 2/2013 | Kumar et al. | 701/19 |
| 8,494,696 | B2 * | 7/2013 | Daum et al. | 701/19 |
| 2002/0183901 | A1 * | 12/2002 | Wolf et al. | 701/19 |
| 2003/0034423 | A1 * | 2/2003 | Hess et al. | 246/167 R |
| 2003/0160586 | A1 * | 8/2003 | Donnelly et al. | 318/684 |
| 2003/0214417 | A1 * | 11/2003 | Peltz et al. | 340/825 |
| 2004/0010432 | A1 | 1/2004 | Matheson et al. | |
| 2004/0064225 | A1 * | 4/2004 | Jammu et al. | 701/29 |
| 2004/0236482 | A1 * | 11/2004 | Kane et al. | 701/19 |
| 2005/0027411 | A1 * | 2/2005 | Meltser et al. | 701/19 |
| 2005/0065674 | A1 | 3/2005 | Houpt et al. | |
| 2006/0266256 | A1 * | 11/2006 | Donnelly et al. | 105/61 |
| 2007/0219680 | A1 | 9/2007 | Kumar et al. | |
| 2007/0233335 | A1 * | 10/2007 | Kumar et al. | 701/22 |
| 2007/0241237 | A1 | 10/2007 | Foy et al. | |
| 2007/0250225 | A1 | 10/2007 | Nickles et al. | |
| 2008/0147256 | A1 | 6/2008 | Liberatore | |
| 2008/0183345 | A1 * | 7/2008 | Chandra et al. | 701/19 |
| 2008/0195269 | A1 * | 8/2008 | Lacy et al. | 701/24 |
| 2009/0118970 | A1 | 5/2009 | Daum et al. | |
| 2009/0186325 | A1 * | 7/2009 | Kumar | 434/219 |
| 2009/0187291 | A1 * | 7/2009 | Daum et al. | 701/2 |
| 2009/0266943 | A1 | 10/2009 | Kumar et al. | |
| 2010/0019103 | A1 | 1/2010 | Kane et al. | |
| 2010/0023190 | A1 * | 1/2010 | Kumar et al. | 701/20 |
| 2010/0052331 | A1 * | 3/2010 | Fonseca | 290/1 A |
| 2010/0131128 | A1 | 5/2010 | Kalyanam et al. | |
| 2011/0060486 | A1 * | 3/2011 | Meltser et al. | 701/19 |
| 2011/0106401 | A1 * | 5/2011 | Kumar et al. | 701/102 |
| 2011/0118899 | A1 * | 5/2011 | Brooks et al. | 701/2 |
| 2011/0118914 | A1 * | 5/2011 | Brooks et al. | 701/20 |
| 2012/0022728 | A1 * | 1/2012 | Hall et al. | 701/19 |
| 2012/0123662 | A1 * | 5/2012 | Heverley, III | 701/101 |
| 2012/0277940 | A1 * | 11/2012 | Kumar et al. | 701/20 |
| 2012/0303237 | A1 * | 11/2012 | Kumar et al. | 701/93 |
| 2012/0310453 | A1 * | 12/2012 | Brooks et al. | 701/20 |
| 2013/0046424 | A1 * | 2/2013 | Gallagher et al. | 701/19 |
| 2013/0131898 | A1 * | 5/2013 | Kumar et al. | 701/20 |
| 2014/0207316 | A1 * | 7/2014 | Kolambekar | 701/19 |

* cited by examiner

```
SCHEDULED TRAIN SUMMARY--ALL EVENTS
TRAIN/JOB GSOVKE 28 HL63UP93214 ORIG STA OVERTON NE NX213
CATEGORY - G-GRAIN TYPE-THRU
SCHEDULED TIMES HAVE BEEN MODIFIED BY TRAIN PERFORMANCE ESTIMATOR
CONDUCTOR C WOODS ENGINEER M MONTMINY

DISTRIBUTED POWER TRAIN D#PCDAAS SCHED PROJ P VAR MAX REQ
****LINK ORIGIN**** *****LINK DEST***** BLSSPTXT TONS TONS M %%% TPA EPA
BLAIRSDEN CA PX648 ROSEVILLE CA RV323 Y...Y..3 13230 210 000 575 024
ROSEVILLE CA RV323 KEYES CA JQ373 Y......3 13230 210 000 575 024
.
ST LOCOMOTIVE EQVP PICKUP SETOUT RECV *NEXT ASSIGNMENT VCAH CDAASD
CD INIT NUMBER AXLE D CIRC-7 CIRC-7 ROAD ****OR NOTES**** CACC SPTXTB DP
X UP 006742 6.0 F NX213 R 50% RX YYYY B6G63F HC
X DG UP 007047 ---- B NX213 YYYY B.G65F H
X UP 007882 12.1 F UX079 YYYY B6G64F H
X UP 006901 12.1 B NX284W W YYYY B6G63F RC
----
TOTAL EPA: 30.2 CUR SEG EPA 24 REQ ROUTE EPA 24
CURRENT TONS = 13222 -----> ACTUAL TPA 438 ROUTE ALLOWED TPA 575
ABOVE TONS AND TPA INCLUDES OFFLINE LOCOMOTIVES
--------------------------------------------------------------------------
CABOOSE ID- NONE REPORTED
```

500

Figure 5

```
*****************************************************************************
ST LOCOMOTIVE PU SO AC EA EA AC VCAH CDAASD LEN WGT
CD INIT NUMB CIRC7 CIRC7 D DC MODEL-# PW DB AX CACC SPTXTB DP FT TN
X UP 6742 NX213 F AC C44AC 6.0 9.8 6 YYYY B6G63F HC 74 208
X DG UP 7047 NX213 B AC C4460AC (12.1)( 9.8) 6 YYYY B.G65F H 76 210
X UP 7882 UX079 F AC C45ACCTE 12.1 9.8 6 YYYY B6G64F H 74 210
---- ---- -- ---- ----
SUB TOTALS: 18.1 19.6 18 224 628
.
X UP 6901 NX284W B AC C4460AC 12.1 9.8 6 YYYY B6G63F RC 76 210
---- ---- -- ---- ----
SUB TOTALS: 12.1 9.8 6 76 210
.
---- ---- -- ---- ----
TOTALS: 30.2 29.4 24 300 838
.
END TRAIN UNITS STATUS
NONE REPORTED
----------------------------------------------
MAXIMUM EPA AND EDBA FOR * GSOVKE 28 * UNLESS OTHERWISE RESTRICTED
52 MAXIMUM EPA FRONT
33 MAXIMUM EDBA FRONT
28 MAXIMUM EPA REAR
28 MAXIMUM EDBA REAR
REAR
----------------------------------------------
***** DUE TO ROUTE POWER REQUIREMENTS AND FUEL CONSERVATION EFFORTS *****
***** ISOLATE / SHUT DOWN / BRING ON-LINE THE FOLLOWING LOCOMOTIVE(S) *****
***** IN ACCORDANCE WITH ABTH RULE 31.8.7 *****
***** WEATHER AND CONDITIONS PERMITTING *****
***** *****
***** UP 007047 ISOLATE AT RV323 *****
***** *****
***** WITH LOCOMOTIVE(S) ISOLATED / SHUT DOWN *****
***** 13230 GROSS TONS INCLUDES ISOLATED LOCOMOTIVES, IF ANY *****
***** 30 TOTAL EQUIVALENT POWERED AXLES *****
***** 439 TONS PER EQUIVALENT POWERED AXLES 30.2 AXLES *****
***** 29 EQUIVALENT DYNAMIC BRAKE AXLES *****
***** 450 TONS PER EQUIVALENT DYNAMIC BRAKE AXLE 29.4 AXLES *****
*****************************************************************************
```

600

Figure 6

```
*****************************************************************
***** DUE TO ROUTE POWER REQUIREMENTS AND FUEL CONSERVATION EFFORTS *****
***** ISOLATE / SHUT DOWN / BRING ON-LINE THE FOLLOWING LOCOMOTIVE(S) *****
***** IN ACCORDANCE WITH ABTH RULE 31.8.7 *****
***** WEATHER AND CONDITIONS PERMITTING *****
***** *****
***** UP 004556 ISOLATE AT C 174 *****   } 700
***** UP 004105 ISOLATE AT C 174 *****
***** *****
***** WITH LOCOMOTIVE(S) ISOLATED / SHUT DOWN *****
***** 7943 GROSS TONS INCLUDES ISOLATED LOCOMOTIVES, IF ANY *****
***** 23 TOTAL EQUIVALENT POWERED AXLES *****
***** 346 TONS PER EQUIVALENT POWERED AXLES 23.0 AXLES *****
***** 15 EQUIVALENT DYNAMIC BRAKE AXLES *****
***** 503 TONS PER EQUIVALENT DYNAMIC BRAKE AXLE 15.8 AXLES *****
*****************************************************************
```

Figure 7

```
*********************************************************************
***** DUE TO ROUTE POWER REQUIREMENTS AND FUEL CONSERVATION EFFORTS *****
***** ISOLATE / SHUT DOWN / BRING ON-LINE THE FOLLOWING LOCOMOTIVE(S) *****
***** IN ACCORDANCE WITH ABTH RULE 31.8.7 *****
***** WEATHER AND CONDITIONS PERMITTING *****          800
***** *****
***** UP 006193 BRING ONLINE AT KP768 *****
***** *****
***** WITH LOCOMOTIVE(S) ISOLATED / SHUT DOWN *****
***** 2528 GROSS TONS INCLUDES ISOLATED LOCOMOTIVES, IF ANY *****
***** 36 TOTAL EQUIVALENT POWERED AXLES *****
***** 70 TONS PER EQUIVALENT POWERED AXLES 36.3 AXLES *****
***** 29 EQUIVALENT DYNAMIC BRAKE AXLES *****
***** 86 TONS PER EQUIVALENT DYNAMIC BRAKE AXLE 29.4 AXLES *****
*********************************************************************
```

Figure 8

SYSTEM AND METHOD FOR AUTOMATED LOCOMOTIVE STARTUP AND SHUTDOWN RECOMMENDATIONS

CROSS-REFERENCE AND PRIORITY CLAIM TO RELATED PATENT APPLICATION

This patent application claims priority to provisional patent application Ser. No. 61/620,838, filed Apr. 5, 2012, entitled "System and Method for Automated Locomotive Startup and Shutdown Recommendations", the entire disclosure of which is incorporated herein by reference.

INTRODUCTION

Inefficient utilization of train locomotives wastes fuel and increases maintenance demands on locomotives. By contrast, efficient locomotive utilization significantly reduces the fuel consumption and reduces maintenance. Furthermore, efficient locomotive utilization is also expected to improve safety because braking power needs vary depending on conditions. In many conventional train operations, it is up to the crew to decide how many and what locomotives should be operated during a trip, relying heavily upon the crew's experience and training. The inventors believe that a significant percentage of trains that have been operated under such conditions have operated in an inefficient manner.

The inventors have developed embodiments of the present invention described herein in an effort to improve upon such shortcomings. For example, the inventors disclose that data representative of a train consist (the train consist comprising a plurality of locomotives and a plurality of cars) and data representative of a route for the train consist can be processed by a processor to automatically determine which locomotives in the train consist should be powered on and which locomotives in the train consist should be shut down for each segment of the route, where the processor is configured to make these determinations based on an analysis of the train consist data and the route data with respect to a plurality of considerations that affect train efficiency. Recommendations for locomotive startups and shutdowns in accordance with such automated determinations can then be presented to the train crew for the crew to use during train operations. It is believed that when train crews are in compliance with such recommendations, significant improvements in efficiency, particularly with respect to fuel consumption, can be achieved.

In an exemplary embodiment, the processor can be configured to generate such recommendations to a train crew at their on-duty time to shut down or turn on specific locomotives in the train consists. Furthermore, in an exemplary embodiment, the processor can be configured to analyze data representative of the total train tonnage, the tons per axle (TPA) rating for the train's route, and dynamic braking power requirements when determining exactly how many and which locomotives need to be turned on (or turned off).

These are merely some of the innumerable aspects of the present invention and should not be deemed an all-inclusive listing of the innumerable aspects associated with the present invention. These and other aspects will become apparent to those skilled in the art in light of the following disclosure and accompanying drawings. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations, and are not intended to limit the scope of the present disclosure.

FIG. 2(*b*) shows an shows an exemplary architecture diagram of an Automated Locomotive Startup and Shutdown Recommendations system in accordance with an exemplary embodiment;

FIGS. 5-8 show exemplary outputs that the system can generate to communicate recommendations about locomotive statuses.

Figure 1:
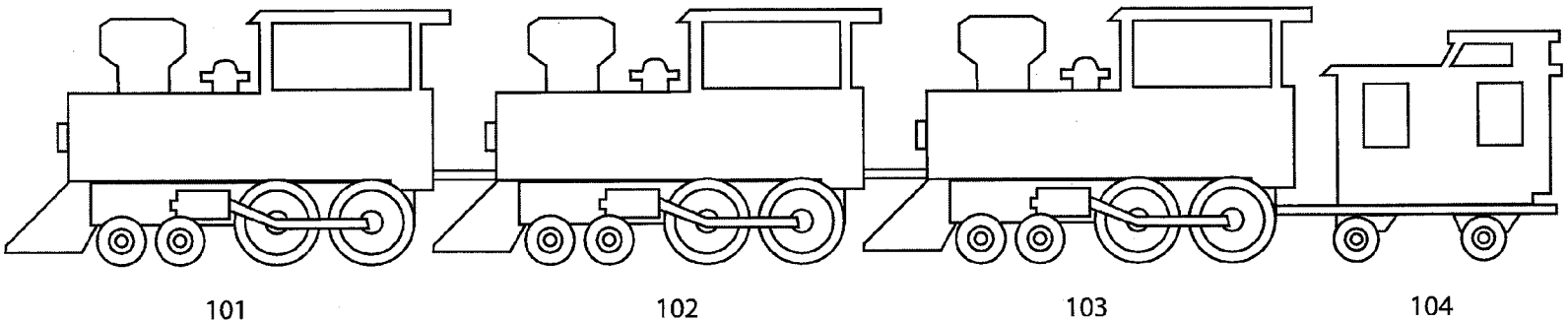
FIG. 1 shows an exemplary train consist.

Reference characters in the written specification indicate corresponding items shown throughout the drawing figures.

DETAILED DESCRIPTION

In the following detailed description, numerous specific details are set forth in order to provide a thorough understanding of the various embodiments of the invention. However, it will be understood by those skilled in the art that the present invention may be practiced without these specific details. In other instances, well-known methods, procedures, and components have not been described in detail so as to obscure the present invention.

An illustrative, but nonlimiting, embodiment of the train consist is shown in FIG. 1. FIG. 1 has a lead locomotive 101 at H1, another locomotive 102 at H2, a third locomotive 103 at H3, and a car 104. The three locomotives, 101, 102, and 103, make up the head locomotive consist (the only consist for this train). A locomotive consist may comprise one or more locomotives that are connected to each other in sequence. For a locomotive consist with two locomotives, the forward locomotive can be referred to as the lead locomotive and the rear locomotive can be referred to as the trailing locomotive. For a locomotive consist with three or more locomotives, once again the forwardmost locomotive can be referred to as the lead locomotive and the rearmost locomotive can be referred to as the trailing locomotive while each of the one or more locomotives that are between the lead locomotive and the trailing locomotive in that locomotive consist can be referred to as a cut-in locomotive (an example of which is shown in FIG. 1). A train consist may have multiple locomotive consists. For example, additional locomotive consists may be added to a train consist to increase the power and/or handling for the train consist in view of operating conditions. While such additional locomotive consists are typically added to the end of the last car in the train consist, this need not necessarily be the case, and there may be multiple locomotives and/or locomotive consists interspersed throughout the train consist, optionally separated by what may be large numbers of train cars, including loaded train cars and unloaded train cars. If a train consist has more than one locomotive consist, the forward-most locomotive consist is the lead locomotive consist. Throughout this disclosure, the terms "locomotive consist" and "consist" are used interchangeably.

Figure 2A:
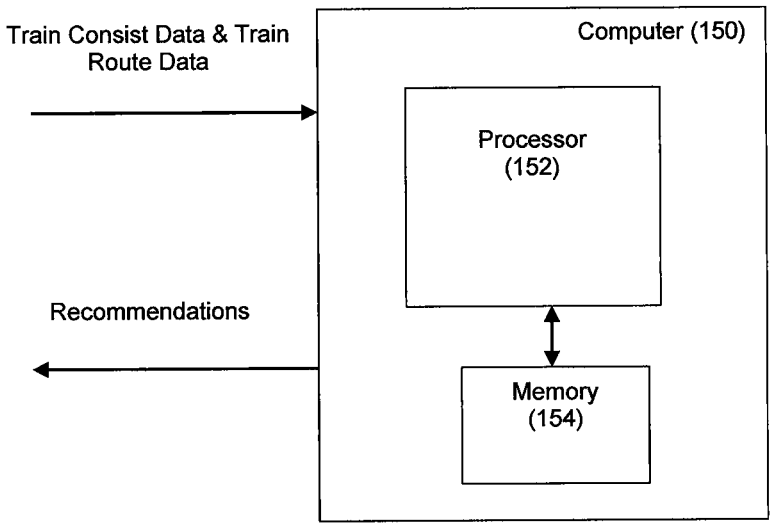
FIG. 2(*a*) shows an exemplary system diagram for an exemplary embodiment.
Figure 2B:
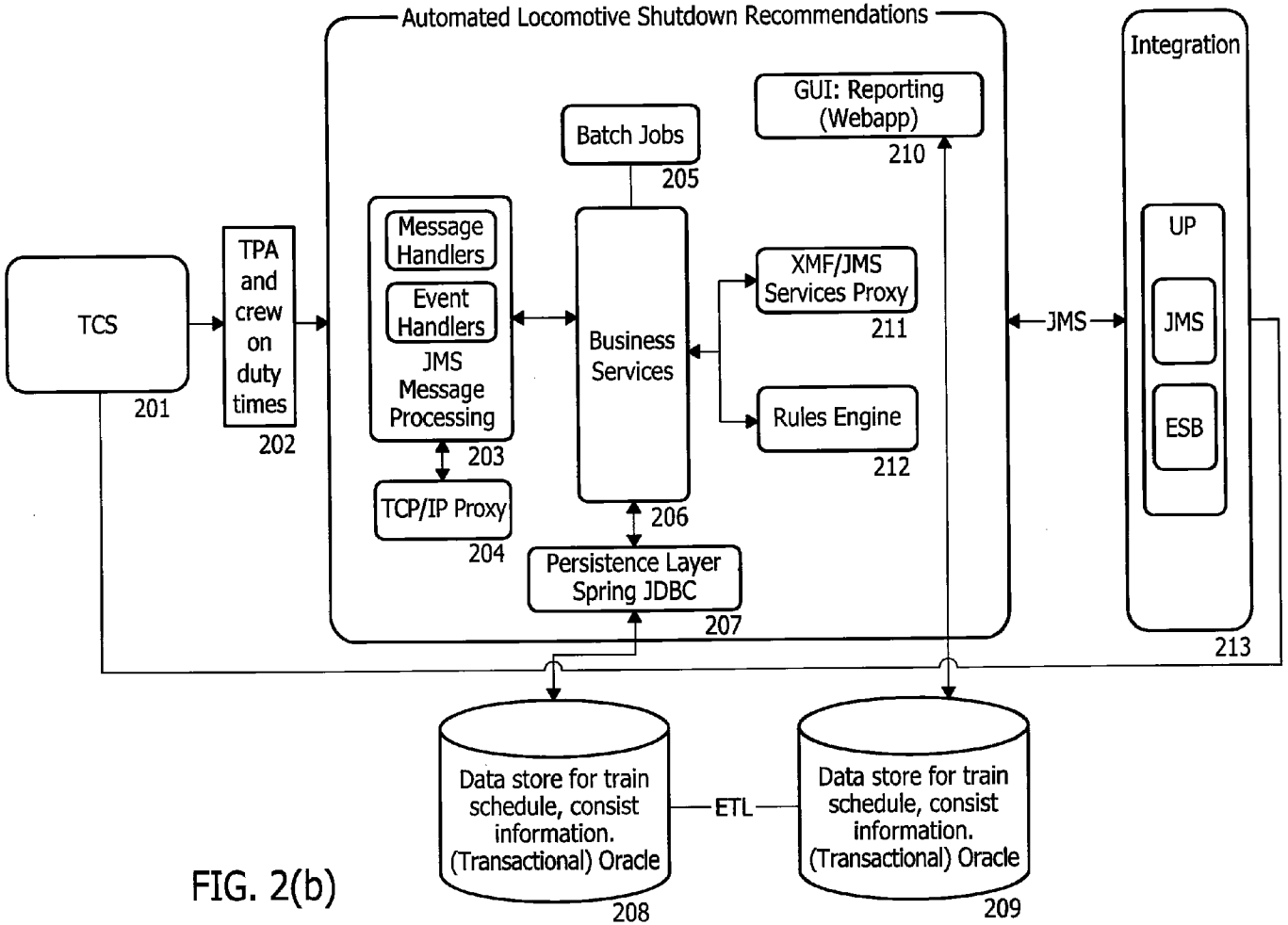

FIG. 2(*a*) depicts an exemplary system diagram for various embodiments. A computer 150, which includes processor 152 and memory 154, operates to receive data that is representative of the train consist and data that is representative of a route for the train consist. Memory 154 can store a plurality of instructions such as software programs that are executable by the processor 152. The memory 154 can also store a plurality of data structures that are processed by the software programs to determine the appropriate recommendations. The memory 154 can take the form of any non-transitory medium upon which data can be stored for access by a processor, including but not limited to a hard drive, random access memory (RAM), removable storage media such as flash drives and the like, etc. The processor 152 executes the programmed instructions to perform the operations described herein and generate recommendations regarding which locomotives in the train consist should be started up or shutdown for a segment of the route.

Further still, the computer 150 may reside in a location remote from the train consist being analyzed. For example, computer 150 may comprise a computer system operated by a train operator remote from the train consists themselves, where the processor 152 may reside on a server for example. In such a case, the computer 150 may include data communication capabilities that permit the computer to communicate the generated recommendations to each train consist's crew. Such communication can be achieved in any of a number of ways via any number of well-known data communication networks. For example, the recommendations can be emailed or otherwise sent to appropriate members of the train crews for receipt via a computing device held by such train crew members (e.g., a tablet computer, mobile device (e.g., smart phone), laptop, etc.). As another example, a computer resident on the train consist itself can receive the communicated recommendations and then provide such received recommendations to the train crew via a user interface, whether it be a screen, printer, or other form of interface.

Moreover, it should be understood that processor 152 may comprise multiple processors, including processors that are distributed across several devices with the processing tasks of the operations described herein being distributed across such processors. The memory 154 can similarly be distributed across multiple memory devices.

FIG. 2(*b*) shows an shows an exemplary architecture diagram of an Automated Locomotive Startup and Shutdown Recommendations system in accordance with an exemplary embodiment. The Automated Locomotive Startup and Shutdown Recommendations System 200 shown in FIG. 2(*b*) evaluates the startup and shutdown possibilities at each crew change. At a crew change, the system 200 gathers data about the outbound tons and the route characteristics until the next crew change point.

The system 200 is not dependent on any particular software technology. The embodiment shown in FIG. 2(*b*) has a message processing component 203, which could be based on Java Messaging Service (JMS) technology. Furthermore, the system 200 may operate over a communication protocol, such as a TCP/IP proxy 204.

The batch jobs component 205 is a central processing component of the architecture. The batch jobs component 205 executes the logic for the system 200. The batch jobs component 205 is triggered at periodic intervals, and it monitors upcoming crew changes. In one embodiment, the batch job component 205 is triggered once every 10 minutes and looks for all crew segments with crew change, also known as a crew-on-duty, within the next 15 minutes. The system 200 can also have a persistence layer 207, which connects to the databases. In the embodiment shown in FIG. 2(*b*), the persistence layer 207 connects through Spring and JDBC technology to two Oracle databases, though any database connectivity and database technology could be used. The databases store train schedule information as well as train consist information. FIG. 2(*b*) shows a transactional database 208 and a reporting database 209, though the number of data stores in not important. Collectively, the transactional database 208 and a reporting database 209 are called the locomotive distribution and assignment (LDA) database.

The services proxy 211 and the rules engine 212 interact with the business services component 206 to generate outputs from the system 200. In the embodiment shown in FIG. 2(*b*), the services proxy is comprised of JMS built with XMF. XMF is a comprehensive set of tools used to build web services over JMS and clients that call them. XMF is used to build any system that needs to expose or call services over JMS. The Java Message Service (JMS) API is a Java Message Oriented Middleware (MOM) API for sending messages between two or more clients.

The Transportation Control System 201 (TCS) is a software system that is responsible for automated railroad operations. In the embodiment shown in FIG. 2(*b*), it is responsible for feeding the train schedules, crew change points, crew-on-duty times 202, outbound tons, and route characteristics to the LDA database and also responsible for displaying the output from the system 200. Output from the system 200 is fed through an integration component 213 to the TCS 201.

Exemplary data that can be obtained from the LDA database about train schedules, crews, routes, etc. can include:

- A data field for uniquely identifying a train
- A data field that provides a power requirement code for the train.
- A 1-byte section number in the train ID field.
- A 7-byte symbol number in the train ID field.
- A 2-byte date in the train ID field.
- A train ID pointer to the train symbol table. The last two characters of the 10 character field can be empty. This could be used as a template field.
- A station number pointer for identifying where interchange took place.
- A data field that identifies a to interchange road.
- A data field that identifies an interchange station number to.
- A data field that identifies a user who created the train record.
- A data field that identifies the date on which the user created the train record.
- A data field that identifies an effective date from the train schedule that can be used as a starting point.
- A data field that identifies a current station for the train (DE normalized).
- A data field that identifies a train category.
- A data field relating to train timeliness. The values can be calculated based on thresholds cataloged in a table associated with the train, a current time, and a scheduled departure time (origin only) or scheduled arrival time (all other stations). Exemplary values can include:
  - 1: On-time
  - 2: Slightly late
  - 3: Very late
- A data field that identifies a service type classification for a train.

A data field that identifies whether the train should be displayed.

A data field that identifies a last reporting type (e.g., A for arrival, D for departure).

A data field that identifies a date/time stamp for last reporting.

A data field that identifies a train cars count per last movement reporting.

A data field that identifies a train length per last reporting.

A data field that identifies train tonnage per last movement reporting.

A data field that includes free form notes.

A data field that identifies a date/time stamp of last event related to the life of the train.

A data field that identifies a life event type.

A data field that identifies a station at which last train life-critical event took place.

A data field that identifies a station sequence number for the train according to the train_schedule table.

A data field that identifies a sub-category for the train

A data field that identifies a priority for the train

A data field that identifies a direction in which the train is headed.

A data field that identifies a common name for a train (e.g., a 14 character field).

A data field that identifies the road on which a locomotive comes in on.

A data field that identifies a prior train from where the units come.

A data field that identifies a next train to which the units go.

A data field that indicates if LMS model is to recommend units to this train.

A data field that identifies a time/date stamp associated with the last TER message received for the train.

A data field that identifies an origin sequence number of the train.

A data field that identifies support for Detecting Trains to be shown on the BLD Outbound from Parent List Box. Exemplary valid values can be:

I—train should be displayed in the Inbound to Parent Listbox of BLD;

O—train should be displayed in the Outbound from Parent Listbox of BLD;

A—train should be displayed in the Other Trains Listbox of BLD;

N—train should not be displayed on the BLD.

A data field that identifies a train ID for which there is a planned location in route.

A data field that identifies a sequence number that, with the train ID, uniquely identifies a row.

A data field that identifies a user who created a train plan.

A data field that identifies a Stn train's schedule.

A data field that identifies a scheduled estimated time of arrival (ETA) for a given location and train per reference schedule for train.

A data field that identifies the direction from which the train is arriving at a station.

A data field that identifies an arrival date for the train at a station.

A data field that identifies an arrival time based on TRUPD and TRTR messages for locations in the schedule subsequent to the reporting location, where a flag can identify whether the arrival times are estimated or actual.

A data field that identifies a scheduled estimated time of departure (ETD) for a train at a station per reference schedule for the train.

A data field that identifies a direction of travel for the train when it departs the station.

A data field that identifies an actual date of departure for the train from the station.

A data field that identifies a departure time for the train based on TRUPD and TRTR messages for locations in the schedule subsequent to the reporting location, where a flag can identify whether the departure times are estimated or actual.

A data field that indicates a planned handling of power at a station for the train. Exemplary values can include:

"–"—no change

"X"—change permitted

"A"—advanced power change point

Note: If train profile/station table is used to create train plan records the first (origin) and last (termination), stations must be set to true ("X").

A data field that indicates plans for crew changes. Exemplary values can include:

0 or blank—No change required

1—locomotive engineer

2—trainmen and reducible

3—trainmen and not reducible

4—locomotive engineer/trainmen and reducible

5—locomotive engineer/trainmen and not reducible

A data field that identifies a number of cars on the train when the train departed the station.

A data field that identifies the length of the train (in feet) when the train departed from the station.

A data field that identifies the trailing tonnage of the train when the train departed from the station.

A data field that identifies equated tonnage calculated at departure time from the reported actual trailing tonnage.

A data field that identifies a date stamp for creation of the train schedule.

A data field that identifies a date stamp for the last update to the train schedule.

A data field that identifies an alpha value for the type of train reporting that a station is to perform. Exemplary values can include:

O—Origin

I—Intermediate

C—Crew change point

T—Termination

A data field that identifies a required horsepower for the train schedule for the departing station.

A data field that identifies the user who last updated the train schedule.

A data field that identifies an estimated crew call date.

A data field that identifies an actual crew call date.

A data field that identifies an inbound/outbound status for the train at the station. Exemplary values can include:

D—Detoured Inbound

A—Annuled Inbound

C—Consolidated Inbound blank—no exception

This can be a two character field; each of inbound and outbound status have one byte of information.

A data field that indicates if power has been verified for the train at that particular station.

A data field that identifies a train date (e.g., in a mm/dd/yyyy format).

A data field that identifies the number of locomotives powering the train per the LDA plan.

A data field that indicates whether the train is deemed an "extra" train.

A data field that identifies the total scheduled horsepower divided by the actual horsepower for the train.

A data field that identifies the required outbound TPA from a given sequence.

A data field that identifies the maximum allowed equivalent powered axle (EPA) in the head consist.

A data field that identifies the maximum allowed EPA in the middle consist(s).

A data field that identifies the maximum allowed EPA in the rear consist.

A data field that indicates whether the train has actually arrived at an associated station.

A data field that indicates whether the train has actually departed an associated station.

A data field that identifies the time at which the crew comes on duty.

A data field that identifies a terrain category for the route segment.

A data field that identifies the amount of outbound tons from a given station in the route when the crew arrived.

A data field that identifies the real outbound tons when the train departed.

A data field that identifies the time at which a recommendation was made.

A data field that identifies the time at which the external system acknowledged that the recommendation was received.

A data field that indicates whether a recommendation was sent.

A data field that identifies a maximum allowed braking power in the head consist.

A data field that identifies a maximum allowed braking power in the middle consist(s).

A data field that identifies a maximum allowed braking power in the rear consist.

A data field that indicates whether an associated station qualifies as a "braking critical" region.

Figure 3:
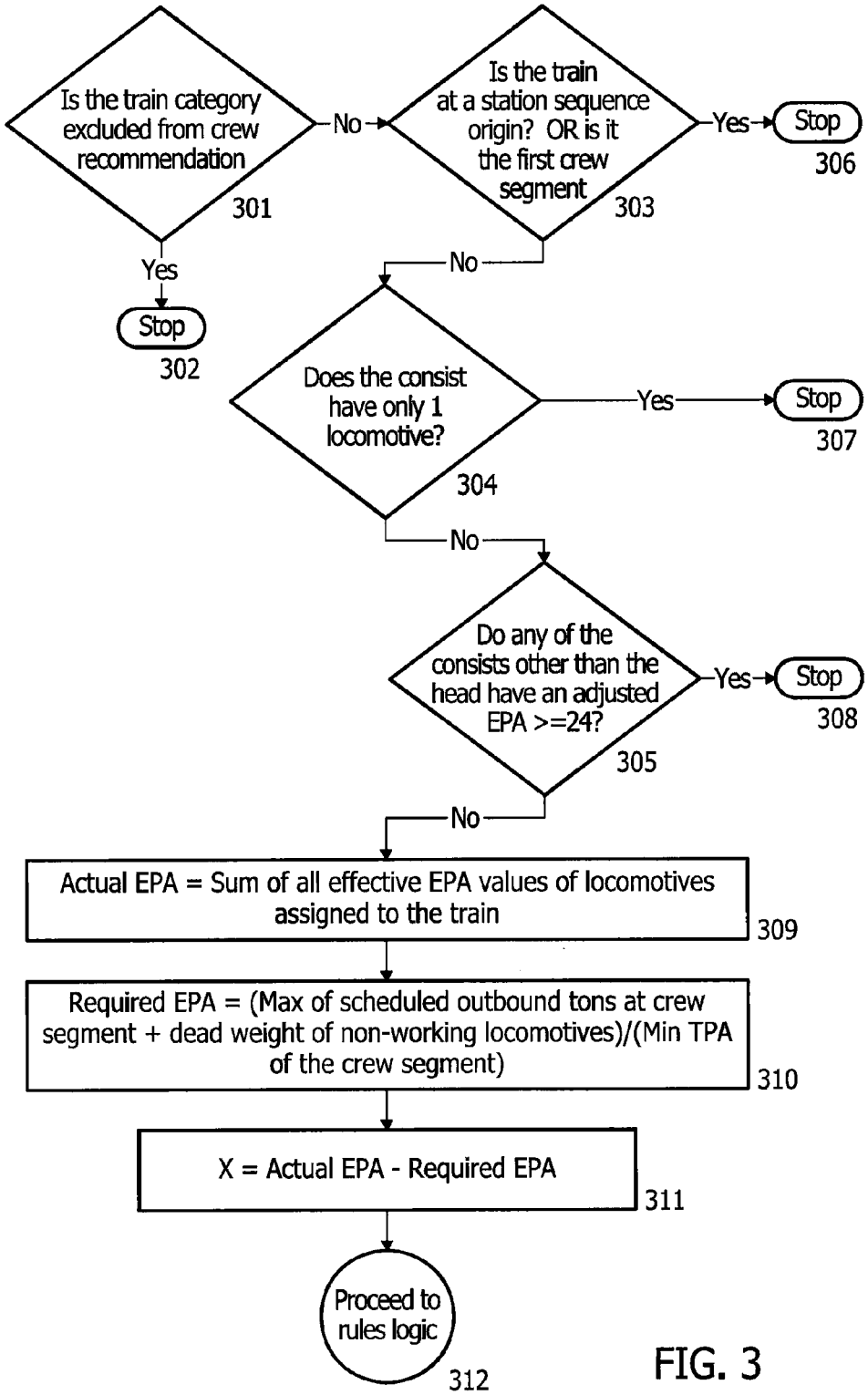
FIG. 3 shows an exemplary flow diagram of a technique for determining excess equivalent powered axle in accordance with an exemplary embodiment.
Figure 4A:
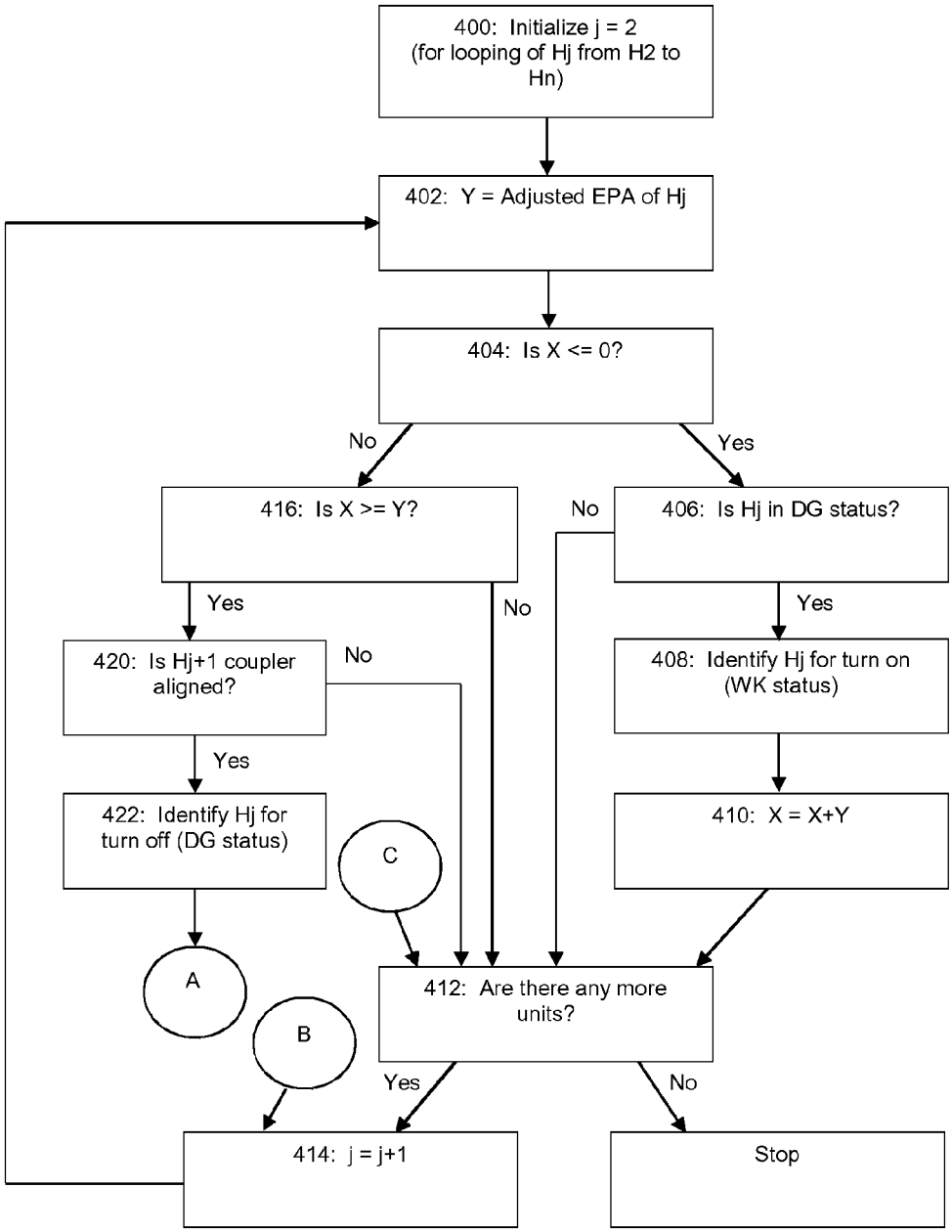
FIGS. 4(*a*) and (*b*) show an exemplary flow diagram of a technique for calculating locomotive start up and shutdown recommendations in accordance with an exemplary embodiment.
Figure 4B:
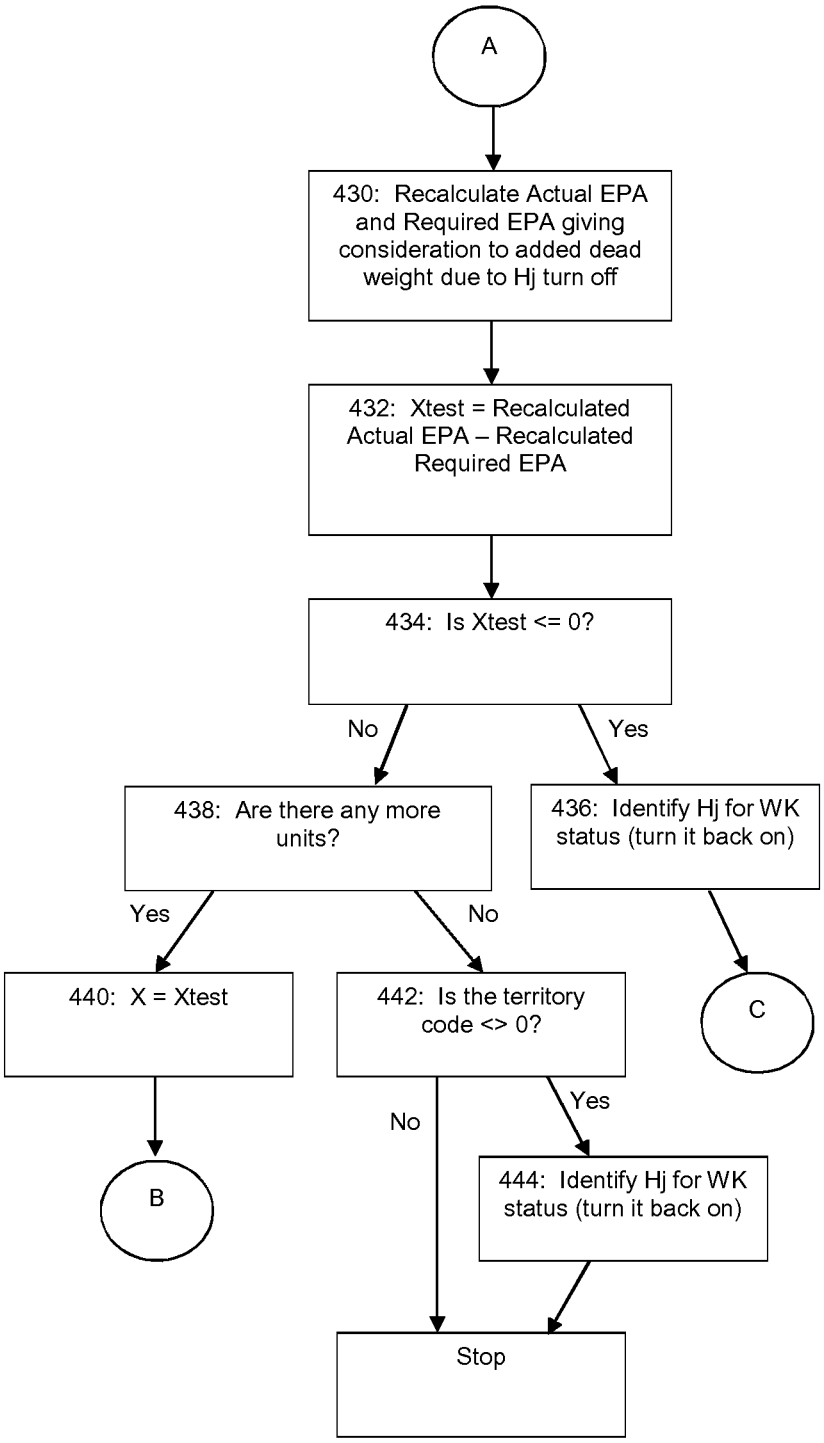

FIGS. 3, 4(*a*) and 4(*b*) show an illustrative, but nonlimiting, embodiment of a technique for automatically determining locomotive startup and shutdown recommendations in accordance with an exemplary embodiment. In the description of the flowcharts, the explanation marked with numerals in angle brackets, <nnn>, will refer to the flowchart blocks bearing that number.

As shown in FIG. 3, the processor begins its process for generating automated locomotive startup and shutdown recommendations by considering whether the train is in a category which is excluded from crew recommendation <301>. Depending upon the desires of a practitioner, some types of trains, such as dummy trains and trackage rights trains, may not be suited for automatic locomotive startup and shutdown recommendations. Train categories can be recorded in a train table, which can be stored in the LDA database.

The LDA database has a record for each train that is planned or actively running on the network. Train table records are purged periodically, and in one embodiment, train table records are purged every 48 hours. Power moves (e.g., locomotives that are being run without any cars, typically done to balance locomotive supply and demand at various terminals) are excluded from the automatic locomotive startup and shutdown recommendations method of this exemplary embodiment as well as local, passenger, yard-job, foreign-trackage, and inbound foreign train types. However, as noted, a practitioner can choose to include any of these train types in the recommendations process or exclude other train types from the recommendations process if desired. If the train type is an excluded category, the processor ends at <302>.

If the train type is not an excluded category at <301>, the processor continues to <303> where it determines whether the train is at a station sequence origin or if this is a first crew segment. If either condition is met, the processor terminates at <306>. If neither condition is met, the processor proceeds to determine whether the train consist has only one locomotive <304>. If the train consist has only one locomotive, there is no need to continue the process of choosing which locomotives to turn on/off, so the processor terminates at <307>.

If there is more than one locomotive in the train consist, the processor proceeds to step 305. At step 305, the processor checks to determine whether any of the locomotive consists in the train consist other than the lead locomotive consist have an adjusted equivalent powered axle (EPA) value greater than or equal to a threshold. EPA is a measure of the power of a locomotive. An adjusted EPA takes into account locomotive defects, locomotive health and mechanical status, or other factors which may alter locomotive power. The adjusted EPA values for the other locomotive consists in the train consist can be read from the LDA data. Business rules will determine the threshold value for the adjusted EPA threshold used by step 305 based on considerations desired by a practitioner. For example, a threshold value of 24 can be used. If any of the locomotive consists other than the head or lead locomotive consist has an adjusted EPA is greater than the threshold value, the processor terminates at <308> for safety reasons. This threshold serves to identify situations where the train's EPA is unusually high, which may serve as a sign that something is not right about the train or that data errors are present. In such a scenario, it is desired that no recommendations be made other than flagging a possible error situation. If none of the locomotive consists other than the head or lead locomotive consist has an adjusted EPA is greater than the threshold value, the processor proceeds to calculate the excess EPA, which informs the processor of how much extra/unneeded power may be present in the train consist for use by the process flow to make decisions about turning on/shutting down locomotives.

Excess EPA can be determined from actual EPA and required EPA values. At <309>, the processor calculates the actual EPA as the sum of all effective EPA values of locomotives assigned to the train consist. The values for the effective EPAs for the subject locomotives are obtained from the LDA database.

At <310>, the processor calculates the required EPA as the maximum of scheduled outbound tons at a crew segment plus dead weight of non-working locomotives divided by the minimum tons per axle (TPA) of the crew segment <310>. A crew segment can be a route segment that falls between consecutive crew changes, which can be determined from the LDA database. Scheduled outbound tonnage is the tonnage of freight that is hauled from a given station. The value for the scheduled outbound tonnage for a crew segment can be determined from the LDA database. Dead weight is the extra tons that are added to the scheduled outbound tons because a non-working locomotive adds dead weight to freight tonnage. The dead weight value can also be determined from the LDA database using knowledge of locomotive weight. The minimum TPA is the minimum amount of power required to haul a ton of weight. A higher minimum TPA would signify the train needs more power to move a ton of weight depending on terrain, topography, region, etc. The LDA database can store TPA data for all stations covered by a route, and the processor can determine the minimum TPA value from this data and crew segment data in the LDA database.

At <311>, the processor then calculates the excess EPA, X, as the difference between the actual EPA and the required EPA. Logically, a positive excess EPA indicates that one or more locomotives may be identified for shutdown, and a negative excess EPA indicates that one or more locomotives may be identified for startup. At <312>, the processor then proceeds to the rules logic of FIGS. 4(*a*) and (*b*) using the excess EPA value, X.

As shown in FIG. 4(*a*), the rules logic at <400> initializes the locomotive index j to 2 for iterating through the locomotives in the locomotive consist, from H2 to Hn, bypassing the lead locomotive because it cannot be shut down. In FIGS. 4(*a*) and (*b*), "Hj" denotes a particular locomotive j in the consist. The rules logic evaluates one locomotive, Hj, at a time. In an exemplary embodiment, the locomotives are ordered within the train consist such that the forwardmost locomotives have relatively lower values for j. For example, H1 would be the lead locomotive, H2 would be the second forwardmost locomotive, and so on.

Each locomotive has an assigned status, indicating whether it is operational or capable of being operational. Table 1 depicts an exemplary set of locomotive statuses.

TABLE 1

| Locomotive Status | |
|---|---|
| DG | Dead Good, locomotive is shut down but capable of being operational |
| WK | Working, locomotive is operational |
| RG | Repositioning Good, locomotive can be used if needed |
| DB | Dead Bad, locomotive is not functional |
| PD | Past Due, locomotive is past due for a federal inspection and cannot be used |

The rules logic of FIGS. 4(*a*) and (*b*) is best described through an example. Consider H2, the second forward-most locomotive in the consist. As noted, the variable X is the excess EPA carried forward from the process flow in FIG. 3. At <402>, the processor sets variable Y as the adjusted EPA of H2. This Y value can be determined from data in the LDA database. The value of the excess EPA determines whether a locomotive is a candidate for start up or shut down. If the excess EPA (X) is less than or equal to 0, the train needs more power and H2 may need to be turned on and possibly changed to a WK status. If the excess EPA (X) is greater than 0, the train has too much power and H2 may be a candidate to turn off. At <404>, the processor compares Y with X to check this condition.

First, one can follow the flow resulting from insufficient locomotive power (see the process flow following the "yes" branch from <404>). If the excess EPA (X) is less than or equal to 0, and H2 has a status of DG <406>, the processor at <408> identifies H2 as a locomotive to be turned on because more EPA is needed. With an exemplary embodiment, locomotives having an RG status can optionally be deemed ineligible for turn on because RG locomotives are typically employed for test runs. At <410>, the processor then adds the adjusted EPA of H2 (Y) to the excess EPA (X) to yield an updated X value. Optionally, the processor can also update other data fields such as data relating to braking needs that are affected by the turning on of H2. The processor next proceeds to check for more locomotives at <412>. If the processor determines at <406> that H2 does not have a status of DG, then the processor proceeds to check for more locomotives at <412>. If there are no more locomotives, the process flow terminates. If there are more locomotives, the value for j is incremented at <414> and the processor returns to <402> for the next iteration. Thus, with this exemplary embodiment, if the status of H2 is RG, DB, or PD, it is not considered as a candidate for startup. The remainder of the flow is discussed in more detail below.

Second, continuing with the example, one can follow the flow resulting from excess locomotive power (see the process flow following the "no" branch from <404>). This process flow relates to decision logic for assessing whether H2 can be turned off. If the excess EPA (X) at step <404> is greater than 0, the processor at <416> determines if the excess EPA (X) is greater than or equal to the adjusted EPA of H2 (Y). If not (indicating that turning off H2 would cause the excess EPA to fall below zero), the processor proceeds to <412> where it checks for more locomotives. If the excess EPA (X) is greater than or equal to the adjusted EPA of H2 (Y) (indicating that there will still be excess power if H2 is turned off), the processor then proceeds through various operations to confirm that H2 should be recommended for turn off. At <409>, the processor determines whether H2 is coupler aligned with H3. Coupler aligned locomotives are discussed in more detail in the Additional Business Rules section below. If H2 is not coupler aligned with H3, H2 is not turned off, and the processor proceeds to check for more locomotives at <412>. If H2 is coupler aligned, the processor at <422> identifies H2 as a locomotive to be turned off. To do so, the processor identifies a recommended status of DG for locomotive H2. From <422>, the processor proceeds to the process flow of FIG. 4(*b*) to assess whether turning off H2 (and thus increasing the dead weight of the train) would cause the actual and required EPA values to change sufficiently to warrant reversing the decision to turn H2 off.

With the process flow of FIG. 4(*b*), the processor at <430> recalculates the Actual EPA and the Required EPA giving consideration to H2 being turned off (e.g., H2 would now be classified as dead weight which would affect the actual and required EPA values). Then, at <432>, the processor calculates a test value for excess power, Xtest, as the difference between the recalculated actual EPA and the recalculated required EPA. Next, at <434>, the processor compares Xtest with 0.

If Xtest is zero or below, this indicates that turning H2 off would cause the train to have insufficient power. In such a scenario, the processor proceeds to <436> where it identifies H2 for being turned back on (WK status). The processor then proceeds to <412> of FIG. 4(*a*). If Xtest is greater than zero, the processor next checks whether there are any more locomotives (<438>).

If <438> results in a determination by the processor that there are no more locomotives, this means that Hj (which in this example is H2) is the trailing locomotive 103. In such a situation, the processor checks for a territory code for the subject trip route/crew segment at <442>. This territory code can be read from the LDA database. In certain territories, it is desired that a trailing locomotive not be shut down for safety braking reasons. Thus, the system can treat certain territory codes as dictating that the trailing locomotive 103 cannot be shut down. If the processor determines at <442> that the territory code for the trip route/crew segment dictates the trailing locomotive remain powered, then the processor proceeds to <444> where the processor identifies H2 to be turned back on (WK status) and the process terminates. Otherwise, if the processor determines at <442> that the territory code for the trip route/crew segment does not dictate the trailing locomotive remain powered, then the process terminates and H2's recommended operational status remains turned off (DG status).

If <438> results in a determination by the processor that there are more locomotives, the processor then uses the value of Xtest as the new value for X and proceeds to <414> of FIG. 4(*a*) to iterate through to the next locomotive using this new value for X.

While FIGS. 3 and 4(*a*)-(*b*) illustrate an exemplary embodiment, it should be understood that the process flow may incorporate additional business rules if desired by a practitioner. Following below is a list of business rules that can be included in the process flow of FIGS. 3 and 4(*a*)-(*b*) if desired by a practitioner, some of which already having been discussed above.

1. The processor should not make a decision to shutdown the lead locomotive.

2. If the locomotive in the H1 position is in a non-working status (anything but WK, DG, or RG) the locomotive in the H2 position must be in a WK or RG status and cannot be shut down. If the locomotive at H2 is also not working, the processor must find the next forwardmost locomotive (H3, H4, etc.) with a status of WK, RG, or DG. If such locomotive is in RG status, the processor should leave it in RG status. If such locomotive is in a DG status, then the processor should change it to WK status. If such locomotive is in WK status, the processor should leave it in WK status.

3. Only locomotives in the head locomotive consist may be isolated and shut down.

4. If there is a need to remove more axles (e.g., the value of X is above a threshold), only WK locomotives can be changed to DG.

5. If there is a need to add more locomotives, only locomotives in DG status can be changed to WK.

6. If a locomotive is already in a DG status, the processor will leave it in a DG status unless there is a need to add more axles to the locomotive consist.

7. Locomotives in an RG status are working and must not be changed to DG status. Locomotives in an RG status are on test runs and it would be undesirable to shut them down given that such locomotives are to be tested. Furthermore, because locomotives in an RG status are working, the processor should add their EPA to the total EPA.

8. Loaded or empty bulk commodity trains (coal, grain, ore, rock, beet, and unit) should operate with a minimum of two locomotives on line when available, although it may be desirable that bulk commodity trains have at least 2 locomotives in WK status at all times. But if there is only one working (WK or RG) locomotive and the rest are PD or DB status, or some other non-working status, the processor makes no recommendation. The nature of the trains for making such determinations can be read from the LDA database.

9. Because locomotives in WK or RG status provide power to the train, the processor should include their EPA in the total EPA. Locomotives in any status other than WK or RG, including DG locomotives, are being towed and are not providing power to the train.

10. To determine total tonnage, the processor should add the weight of non-working locomotives (everything but locomotives having a WK and RG status) to the scheduled trailing tons to compute the total trailing tons outbound. When a WK status locomotive is changed to DG status, the processor should add the weight of that locomotive to the tonnage total to compute a new TPA. When a DG status locomotive is changed to WK status, the processor should not include that locomotive's weight the total tonnage before computing the new TPA.

11. If there is a need to add more working locomotives or reduce the number of working locomotives, the processor should work front to back. The first locomotive to be considered will be the one immediately behind the lead locomotive (H2).

12. If the train has a rear locomotive consist, the processor should compute the total rear EPA (e.g., the sum of the EPAs for each locomotive in the rear locomotive consist). The processor should then truncate the rear EPA to work with a whole number only. This means that the processor drops the decimal part of the rear EPA total and works only with the integer portion of the rear EPA total. The processor also determines the most restrictive (lowest) limit of total number of powered axles in the rear consist of the train in the train schedule table for the crew segment, whose value can be referred to as Q. If the rear EPA total is not greater than Q, the processor then determines that the locomotives in the head consist are eligible to be isolated and shut down. If the rear EPA is not less than Q, the train is assumed to be operating in controlled tractive effort (CTE) mode and the processor adjusts the total EPA for CTE mode. The processor then uses this adjusted total EPA in its calculations. If the total rear EPA cannot be reduced to less than Q, the processor determines that no locomotives in the head consist are eligible to be isolated and shut down.

13. When determining the most restrictive (lowest) limit of total number of powered axles in the rear consist of the train or the required EPA in the train schedule table, the processor will ignore all range stations. Range stations can be identified in the train table as always having an even scheduled station number.

14. Upon encountering a station in the train schedule table that has null values for the limit of total number of powered axles in the rear consist, required EPA, or the critical dynamic braking flag, the processor should create a log entry detailing that row in the table and ignore that station and continue the calculations without that station.

15. If a cut-in locomotive consist's EPA is not less than a threshold value such as 24, no locomotives in the head locomotive consist may be isolated and shut down. If there is more than one cut-in group each group will be considered individually. If either of the cut-in locomotive consist groups is not less than 24 EPA, no locomotives in the head consist may be isolated and shut down. If the cut-in consist can be reduced to less than 24 EPA because of CTE locomotives, the processor reduces the EPA via CTE technology that allows the locomotive to provide reduced tractive power in the mid and rear consists and uses the new total EPA for its calculations.

16. In territories with critical dynamic braking requirements (as determined from the LDA database), the processor can ensure that enough locomotives are on-line to supply sufficient braking needs.

17. If a locomotive consist has a locomotive with a non-alignment controlled coupler and there is a locomotive with an alignment controlled coupler after it, that locomotive should be on-line. If the non-aligned locomotive is in DG status, the following locomotive (the one with coupler alignment) should be turned on. Locomotives that are alignment controlled coupler equipped are indicated as such in the LDA database. If the processor finds a locomotive that is not equipped with an alignment controlled coupler, the next locomotive in the consist must be working (WK or RG status). In such a situation, if the next locomotive is in DP or PD status, then the next good locomotive should be turned on. Thus, if the next locomotive is in DG status, the processor will change it to WK status. If the next locomotive is in a non-working status (anything but WK, DG, or RG status), the processor should leave it in that status and check the next locomotive. If the consist has more than one non alignment controlled coupler locomotive, the locomotive following each should be working as set forth above. The processor can recommend to shutdown locomotives but with the constraint that it cannot recommend to shut down a locomotive immediately behind a non-alignment controlled coupler locomotive. It is possible to create a recommendation to isolate and shut down a non-alignment controlled coupler locomotive, but the following locomotive must be in a WK status.

Upon termination of the process flow of FIGS. 3 and 4(*a*)-(*b*), the processor is able to generate a recommendation about locomotive statuses for a particular trip or route segment. FIGS. 5-8 illustrate exemplary outputs that can be created by system 200 in this regard.

FIG. 5 depicts an exemplary output showing a recommendation 500 that a particular locomotive (locomotive UP 00747) is to be placed in a DG status for a particular trip segment. Thus, the process flow of FIGS. 3 and 4 for this trip segment has identified locomotive UP 00747 for a shutdown.

FIG. 6 shows an exemplary output from the TCS system which can be printed by a train crew as train consist documents at the tie up time. In the example of FIG. 6, the system 200 has created a recommendation 600 that locomotive UP 70407 be shutdown for the trip segment starting at the location identified by "RV323". While this example uses a particular geographic location coding system used by a practitioner, it should be understood that any technique for communicating a location can be used.

FIG. 7 shows another exemplary output from the system 200 which includes a recommendation 700 for a different train recommending that two locomotives be shut down. In this example, locomotives UP 004556 and UP 004105 are recommended for shutdown for the trip segment starting at the location identified by "C 174". Once again, while this example uses a particular geographic location coding system used by a practitioner, it should be understood that any technique for communicating a location can be used.

FIG. 8 shows yet another exemplary output from the system 200 which includes a recommendation 800 that a particular locomotive (UP 006193) be started up for a particular trip segment (the segment starting at the location identified by "KP768"). Once again, while this example uses a particular geographic location coding system used by a practitioner, it should be understood that any technique for communicating a location can be used.

Thus, there have been shown and described several embodiments of an invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be encompassed by this disclosure.

What is claimed is:

1. A method comprising:

processing, by a processor, train consist data and route data for a train consist by applying a plurality of rules using the train consist data and the route data, wherein the train consist comprises a locomotive consist, the locomotive consist comprising a lead locomotive and a rearmost locomotive, wherein the rules comprise a territory rule that is configured to prevent a shut down recommendation of the rearmost locomotive in a predefined territory as determined from the route data, wherein the processing step further includes applying the territory rule by:

determining territory data for a route segment based on the route data;

determining whether the territory data corresponds to the predefined territory, the predefined territory being indicative of a particular territory where safety braking considerations apply; and in response to a positive determination that the territory data corresponds to the predefined territory, preventing the rearmost locomotive from being recommended for a shut down; and in response to the processing, automatically generating, by the processor, a recommendation that is indicative of how many and which locomotives of the train consist should be powered on or shut down for the route segment.

2. The method of claim 1 wherein the plurality of rules comprise rules that are indicative of efficiency considerations for the train consist.

3. The method of claim 1 wherein the processing step comprises the processor applying at least one rule that is based on a dynamic braking consideration for the train consist.

4. The method of claim 1 wherein the processing step comprises the processor applying at least one rule that is based on a tons per axle (TPA) rating for the train consist.

5. The method of claim 1 further comprising:

communicating the automatically generated recommendation to a train crew for the train consist; and operating the locomotive consist in accordance with the recommendation for the route segment to provide power for and drive the train consist over the route segment.

6. The method of claim 5 further comprising the processor repeating the processing and automatically generating steps for each of a plurality of route segments, and wherein the communicating step comprises communicating the automatically generated recommendation to the train crew for the train consist in time for the train crew to implement the recommendation for each route segment.

7. The method of claim 1 further comprising the processor accessing a memory to read a plurality of data structures associated with the train consist data and the route data.

8. The method of claim 1 wherein a data associated with the recommendation comprises an identification of a particular locomotive in the train consist that is recommended for shutdown and an identification of a route segment for which that particular locomotive is recommended for shutdown.

9. The method of claim 8 wherein the route segment identification comprises an identifier for a geographic location associated with a start of the route segment.

10. The method of claim 1 wherein the train consist data comprises a data structure representative of an operational status for each locomotive in the train consist, each locomotive's operational status being indicative of whether that locomotive is to be powered on or shut down for the route segment, and wherein the processing step comprises:

the processor determining a required power amount for the train consist based on the train consist data and the route data;

the processor determining an actual power amount for the train consist based on power data for the locomotives;

the processor determining whether an excess power amount exists by comparing the determined actual power amount with the required power amount; and in response to a determination that an excess power amount exists, the processor applying a plurality of rules to the train consist data and the route data to determine whether a locomotive in the train consist having an operational status indicative of it being powered on should have its operational status changed to being shut down.

11. The method of claim 10 wherein the train consist data further comprises a data structure representative of a power amount for each locomotive in the train consist, and wherein the processing step comprises:

the processor determining whether a locomotive in the train consist has an operational status indicative of it being powered on and whether the locomotive has a power amount less than the determined excess power amount; and in response to the processor determining that the locomotive has an operational status indicative of it being powered on and that the locomotive has a power amount less than the determined excess power amount, the processor testing whether the locomotive can have its operational status changed to be indicative of it being shut down, wherein the testing includes application of the territory rule; and wherein the automatically generating step comprises, in response to the testing resulting in a determination that the locomotive can have its operational status changed to be indicative of it being shut down, the processor automatically generating recommendation data for the locomotive to be shut down.

12. The method of claim 10 wherein the processing step further comprises:

in response to a determination that an excess power amount does not exist, the processor determining that a locomotive in the train consist having an operational status indicative of it being shut down should have its operational status changed to being indicative of being powered on.

13. The method of claim 1 wherein the rules further comprise a dead weight consideration rule that is configured to prevent a shut down recommendation of a locomotive in the locomotive consist if dead weight added to the train consist by a shut down of that locomotive would cause a shortage of power for the locomotive consist.

14. The method of claim 1 wherein the rules further comprise a lead locomotive bypass rule that is configured to prevent a shut down recommendation of the lead locomotive.

15. The method of claim 1 wherein the processing step further comprises:

the processor determining whether a locomotive power requirement for the train consist is satisfied should the locomotive under consideration be shut down for the route segment;

the processor determining whether the locomotive under consideration is the rearmost locomotive; and in response to a determination that the locomotive under consideration is the rearmost locomotive, the processor performing the territory rule applying step; and wherein the territory rule applying step further comprises:

in response to a negative determination that the territory data does not correspond to the predefined territory and a determination that the locomotive power requirement for the train consist is satisfied should the rearmost locomotive be shut down for the route segment, identifying the rearmost locomotive for recommended shut down for the route segment.

16. The method of claim 15 wherein the locomotive consist further comprises a cut-in locomotive.

17. The method of claim 1 wherein the rules further comprise a coupler alignment rule that is configured to prevent a shut down recommendation of a first locomotive in front of a second locomotive that is not coupler aligned with the first locomotive.

18. The method of claim 1 wherein the rules further comprise a power threshold rule that is configured to prevent a shut down recommendation of any locomotives in a lead locomotive consist for the train consist in response to a determination that a power amount for a locomotive consist in the train consist other than the lead locomotive consist exceeds a threshold.

19. An apparatus comprising:

a memory for storing train consist data and route data for a train consist, the train consist comprising a locomotive consist and a plurality of cars, the locomotive consist comprising a lead locomotive and a rearmost locomotive; and a processor configured to (1) apply the train consist data and the route data using a plurality of rules, wherein the rules comprise a territory rule that is configured to prevent a shut down recommendation of the rearmost locomotive in a predefined territory as determined from the route data, wherein the processor is further configured to, as part of applying the territory rule, (i) determine territory data for a route segment based on the route data, (ii) determine whether the territory data corresponds to the predefined territory, the predefined territory being indicative of a particular territory where safety braking considerations apply, and (iii) in response to a positive determination that the territory data corresponds to the predefined territory, prevent the rearmost locomotive from being recommended for a shut down, and (2) in response to applying the train consist data and the route data using the rules, automatically generate recommendation data that is indicative of how many and which locomotives of the train consist should be powered on or shut down for a route segment.

20. The apparatus of claim 19 wherein the plurality of rules comprise rules that are indicative of efficiency considerations for the train consist.

21. The apparatus of claim 19 wherein the processor is further configured to apply at least one rule that is based on a dynamic braking consideration for the train consist.

22. The apparatus of claim 19 wherein the processor is further configured to apply at least one rule that is based on a tons per axle (TPA) rating for the train consist.

23. The apparatus of claim 19 wherein the processor is further configured to communicate the automatically generated recommendation to a train crew for the train consist.

24. The apparatus of claim 23 wherein the processor is configured to (1) repeat the processing operations for each of a plurality of route segments, and (2) communicate the automatically generated recommendation to the train crew for the train consist in time for the train crew to implement the recommendation for each route segment.

25. The apparatus of claim 19 wherein the processor is further configured to access the memory to read a plurality of data structures associated with the train consist data and the route data.

26. The apparatus of claim 19 wherein the recommendation data comprises an identification of a particular locomotive in the train consist that is recommended for shutdown and an identification of a route segment for which that particular locomotive is recommended for shutdown.

27. The apparatus of claim 26 wherein the route segment identification comprises an identifier for a geographic location associated with a start of the route segment.

28. The apparatus of claim 19 wherein the train consist data comprises a data structure representative of an operational status for each locomotive in the train consist, each locomotive's operational status being indicative of whether that locomotive is to be powered on or shut down for the route segment, and wherein the processor is further configured to:

determine a required power amount for the train consist based on the train consist data and the route data;

determine an actual power amount for the train consist based on power data for the locomotives;

determine whether an excess power amount exists by comparing the determined actual power amount with the required power amount; and in response to a determination that an excess power amount exists, apply a plurality of rules to the train consist data and the route data to determine whether a locomotive in the train consist having an operational status indicative of it being powered on should have its operational status changed to being shut down.

29. The apparatus of claim 28 wherein the train consist data further comprises a data structure representative of a power amount for each locomotive in the train consist, and wherein the processor is further configured to:

determine whether a locomotive in the train consist has an operational status indicative of it being powered on and whether the locomotive has a power amount less than the determined excess power amount;

in response to a determination by the processor that the locomotive has an operational status indicative of it being powered on and that the locomotive has a power amount less than the determined excess power amount, test whether the locomotive can have its operational status changed to be indicative of it being shut down, wherein the testing operation includes an application of the territory rule; and in response to the test resulting in a determination by the processor that the locomotive can have its operational status changed to be indicative of it being shut down, automatically generate recommendation data for the locomotive to be shut down.

30. The apparatus of claim 28 wherein the processor is further configured to, in response to a determination that an excess power amount does not exist, determine that a locomotive in the train consist having an operational status indicative of it being shut down should have its operational status changed to being indicative of being powered on.

31. The apparatus of claim 29 wherein the processor is further configured to, as part of the testing operation:

recalculate the required power amount in view of the locomotive being shut down;

determine whether the train consist would have sufficient power with the locomotive shut down based on the recalculated power amount; and in response to a determination by the processor that the train consist would not have sufficient power with the locomotive shut down, determine that the locomotive's operational status should remain indicative of it being powered on.

32. The apparatus of claim 31 wherein the processor is further configured to iterate the processing operation over a plurality of locomotives in the train consist other than the head locomotive to determine whether any of the plurality of locomotives in the train consist other than the head locomotive can be recommended for shut down.

33. The apparatus of claim 19 wherein the rules further comprise a territory rule that is configured to prevent a shut down recommendation of a trailing locomotive in a predefined territory as determined from the route data.

34. The apparatus of claim 19 wherein the rules further comprise a coupler alignment rule that is configured to prevent a shut down recommendation of a first locomotive in front of a second locomotive that is not coupler aligned with the first locomotive.

35. The apparatus of claim 19 wherein the rules further comprise a power threshold rule that is configured to prevent a shut down recommendation of any locomotives in a lead locomotive consist for the train consist in response to a determination that a power amount for a locomotive consist in the train consist other than the lead locomotive consist exceeds a threshold.

36. The non-transitory computer-readable storage medium of claim 35 wherein the processor-executable instructions are further configured to, upon execution by the processor, cause the computer to:

determine whether a locomotive power requirement for the train consist is satisfied should the locomotive under consideration be shut down for the route segment;

determine whether the locomotive under consideration is the rearmost locomotive; and in response to a determination that the locomotive under consideration is the rearmost locomotive, apply the territory rule; and wherein application of the territory rule further causes the computer to:

in response to a negative determination that the territory data does not correspond to the predefined territory and a determination that the locomotive power requirement for the train consist is satisfied should the rearmost locomotive be shut down for the route segment, identify the rearmost locomotive for recommended shut down for the route segment.

37. A non-transitory computer-readable storage medium comprising:

a plurality of instructions stored on the non-transitory computer-readable storage medium and executable by a processor of a computer, wherein the instructions, when executed by the processor, are configured to cause the computer to:

process train consist data and route data for a train consist, the train consist comprising a locomotive consist and a plurality of cars, the locomotive consist comprising a lead locomotive and a rearmost locomotive;

apply the train consist data and the route data using a plurality of rules, wherein the rules comprise a territory rule that is configured to prevent a shut down recommendation of the rearmost locomotive in a predefined territory as determined from the route data, wherein execution of the territory rule further causes the computer to (a) determine territory data for a route segment based on the route data, (b) determine whether the territory data corresponds to the predefined territory, the predefined territory being indicative of a particular territory where safety braking considerations apply, and (c) in response to a positive determination that the territory data corresponds to the predefined territory, prevent the rearmost locomotive from being recommended for a shut down; and in response to applying the train consist data and the route data using the rules, automatically generate recommendation data that is indicative of how many and which locomotives of the train consist should be powered on or shut down for the route segment.

38. The non-transitory computer-readable storage medium of claim 37 wherein the plurality of rules comprise rules that are indicative of efficiency considerations for the train consist.

39. The non-transitory computer-readable storage medium of claim 37 wherein the processor-executable instructions are further configured to, upon execution by the processor, cause the computer to apply at least one rule that is based on a dynamic braking consideration for the train consist.

40. The non-transitory computer-readable storage medium of claim 37 wherein the processor-executable instructions are further configured to, upon execution by the processor, cause the computer to apply at least one rule that is based on a tons per axle (TPA) rating for the train consist.

41. The non-transitory computer-readable storage medium of claim 37 wherein the processor-executable instructions are further configured to, upon execution by the processor, cause the computer to communicate the automatically generated recommendation to a train crew for the train consist.

42. The non-transitory computer-readable storage medium of claim 41 wherein the processor-executable instructions are further configured to, upon execution by the processor, cause the computer to (1) repeat the operations for each of a plurality of route segments, and (2) communicate the automatically generated recommendation to the train crew for the train consist in time for the train crew to implement the recommendation for each route segment.

43. The non-transitory computer-readable storage medium of claim 37 wherein the processor-executable instructions are further configured to, upon execution by the processor, cause the computer to access a memory to read a plurality of data structures associated with the train consist data and the route data.

44. The non-transitory computer-readable storage medium of claim 37 wherein the recommendation data comprises an identification of a particular locomotive in the train consist that is recommended for shutdown and an identification of a route segment for which that particular locomotive is recommended for shutdown.

45. The non-transitory computer-readable storage medium of claim 44 wherein the route segment identification comprises an identifier for a geographic location associated with a start of the route segment.

46. The non-transitory computer-readable storage medium of claim 37 wherein the train consist data comprises a data structure representative of an operational status for each locomotive in the train consist, each locomotive's operational status being indicative of whether that locomotive is to be powered on or shut down for the route segment, and wherein the processor-executable instructions are further configured to, upon execution by the processor, cause the computer to:

determine a required power amount for the train consist based on the train consist data and the route data;

determine an actual power amount for the train consist based on power data for the locomotives;

determine whether an excess power amount exists by comparing the determined actual power amount with the required power amount; and in response to a determination that an excess power amount exists, apply a plurality of rules to the train consist data and the route data to determine whether a locomotive in the train consist having an operational status indicative of it being powered on should have its operational status changed to being shut down.

47. The non-transitory computer-readable storage medium of claim 46 wherein the train consist data further comprises a data structure representative of a power amount for each locomotive in the train consist, and wherein the processor-executable instructions are further configured to, upon execution by the processor, cause the computer to:

determine whether a locomotive in the train consist has an operational status indicative of it being powered on and whether the locomotive has a power amount less than the determined excess power amount;

in response to a determination that the locomotive has an operational status indicative of it being powered on and the locomotive has a power amount less than the determined excess power amount, test whether the locomotive can have its operational status changed to be indicative of it being shut down, wherein the testing operation includes an application of the territory rule; and in response to the test resulting in a determination that the locomotive can have its operational status changed to be indicative of it being shut down, automatically generate recommendation data for the locomotive to be shut down.

48. The non-transitory computer-readable storage medium of claim 46 wherein the processor-executable instructions are further configured, upon execution by the processor, cause the computer to, in response to a determination that an excess power amount does not exist, determine that a locomotive in the train consist having an operational status indicative of it being shut down should have its operational status changed to being indicative of being powered on.

49. The non-transitory computer-readable storage medium of claim 37 wherein the rules further comprise a dead weight consideration rule that is configured to prevent a shut down recommendation of a locomotive in a lead locomotive consist of the train consist if dead weight added to the train consist by a shut down of that locomotive would cause a shortage of power for the lead locomotive consist.

50. The non-transitory computer-readable storage medium of claim 37 wherein the rules further comprise a lead locomotive bypass rule that is configured to prevent a shut down recommendation of the lead locomotive.

51. The non-transitory computer-readable storage medium of claim 37 wherein the rules further comprise a coupler alignment rule that is configured to prevent a shut down recommendation of a first locomotive in front of a second locomotive that is not coupler aligned with the first locomotive.

52. The non-transitory computer-readable storage medium of claim 37 wherein the rules further comprise a power threshold rule that is configured to prevent a shut down recommendation of any locomotives in a lead locomotive consist for the train consist in response to a determination that a power amount for a locomotive consist in the train consist other than the lead locomotive consist exceeds a threshold.

53. The non-transitory computer-readable storage medium of claim 37 wherein the rules further comprise (1) a power threshold rule that is configured to prevent a shut down recommendation of any locomotives in a lead locomotive consist for the train consist in response to a determination that a power amount for a locomotive consist in the train consist other than the lead locomotive consist exceeds a threshold, (2) a dead weight consideration rule that is configured to prevent a shut down recommendation of a locomotive in a lead locomotive consist of the train consist if dead weight added to the train consist by a shut down of that locomotive would cause a shortage of power for the lead locomotive consist, (3) a coupler alignment rule that is configured to prevent a shut down recommendation of a first locomotive in front of a second locomotive that is not coupler aligned with the first locomotive, and (4) a lead locomotive bypass rule that is configured to prevent a shut down recommendation of the lead locomotive.

* * * * *